US006731762B1

(12) United States Patent
Chiang

(10) Patent No.: US 6,731,762 B1
(45) Date of Patent: May 4, 2004

(54) WIRELESS MICROPHONE HAVING A CHARGER CIRCUIT AND A TRANSMITTER CIRCUIT THAT SHARE A COMMON CONDUCTOR PAIR

(76) Inventor: Kun-Tien Chiang, No. 85, Chang-Hsing 1st St., Jen-Te Hsiang, Tainan Hsien (TW)

( * ) Notice: Subject to any disclaimer, the term of this patent is extended or adjusted under 35 U.S.C. 154(b) by 0 days.

(21) Appl. No.: 10/388,420

(22) Filed: Mar. 17, 2003

(51) Int. Cl.[7] ..... H04R 3/00
(52) U.S. Cl. ..... 381/92; 381/111; 381/122
(58) Field of Search ..... 381/122, 91, 92, 381/111, 112, 113, 114, 115, 116, 117

(56) References Cited

U.S. PATENT DOCUMENTS 4,910,795 A * 3/1990 McCowen et al. ..... 455/95
5,881,156 A * 3/1999 Treni et al. ..... 381/91
5,999,801 A * 12/1999 Johnson ..... 455/92
6,025,553 A * 2/2000 Lee ..... 84/610
6,184,651 B1 * 2/2001 Fernandez et al. ..... 320/108

* cited by examiner

*Primary Examiner*—Xu Mei
*Assistant Examiner*—Justin I. Michalski
(74) *Attorney, Agent, or Firm*—Hunton & Williams LLP

(57) ABSTRACT

A wireless microphone includes a circuit board mounted in a housing, and a common conductor pair mounted on the circuit board. Impedance coils and isolation capacitors are provided to interconnect a charger circuit and a transmitter circuit to the common conductor pair such that, when a direct current power signal is supplied to the common conductor pair, the power signal will be prevented from reaching the transmitter circuit and will be directed to the charger circuit and such that, when the transmitter circuit outputs a microphone pick-up signal for transmission, the microphone pick-up signal will be prevented from reaching the charger circuit and will be directed to the common conductor pair for wireless transmission thereby.

4 Claims, 3 Drawing Sheets

WIRELESS MICROPHONE HAVING A CHARGER CIRCUIT AND A TRANSMITTER CIRCUIT THAT SHARE A COMMON CONDUCTOR PAIR

BACKGROUND OF THE INVENTION

1. Field of the Invention

The invention relates to a wireless microphone, more particularly to a wireless microphone having a charger circuit and a transmitter circuit that share a common conductor pair.

2. Description of the Related Art

A conventional wireless microphone includes a transmitter circuit for outputting a microphone pick-up signal, and a charger circuit for charging an internal battery unit. In the conventional wireless microphone, because an antenna for the transmitter circuit and a conductor pair for the charger circuit are separate, the size of a circuit board in a housing of the wireless microphone is undesirably large, which increases the weight and which has an adverse affect on the portability of the wireless microphone.

SUMMARY OF THE INVENTION

Therefore, the object of the present invention is to provide a wireless microphone having a charger circuit and a transmitter circuit that share a common conductor pair so as to overcome the aforesaid drawbacks of the prior art.

According to the present invention, a wireless microphone comprises a housing, a circuit board mounted in the housing, a common conductor pair mounted on the circuit board, a charger circuit, a transmitter circuit, first and second impedance coils, and first and second isolation capacitors. The common conductor pair includes first and second conductors, each of which has a charging end and a connecting end. The charger circuit has a grounded first power terminal and a second power terminal. The transmitter circuit has a grounded first signal terminal and a second signal terminal. The first impedance coil has a grounded first coil terminal and a second coil terminal connected to the connecting end of the first conductor. The second impedance coil has a first coil terminal connected to the second power terminal, and a second coil terminal connected to the connecting end of the second conductor. The first isolation capacitor has a first capacitor terminal connected to the second signal terminal, and a second capacitor terminal connected to the connecting end of the second conductor. The second isolation capacitor is connected across the first and second conductors.

Therefore, when a direct current power signal is supplied to the charging ends of the first and second conductors, the power signal will be prevented from reaching the transmitter circuit by the first isolation capacitor and will be directed to the charger circuit by the second impedance coil.

Moreover, when the transmitter circuit outputs a microphone pick-up signal for transmission, the microphone pick-up signal will be prevented from reaching the charger circuit by the first and second impedance coils and will be directed to the first and second conductors through the first and second isolation capacitors for wireless transmission by the first and second conductors.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
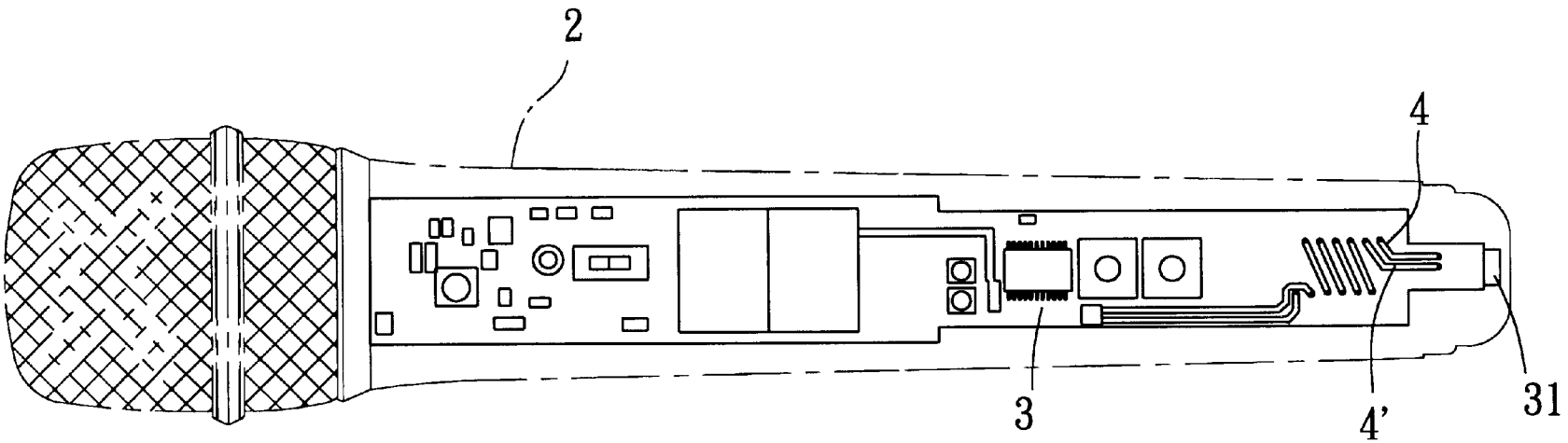
FIG. 1 is a schematic view of the preferred embodiment of a wireless microphone according to the present invention.
Figure 2:
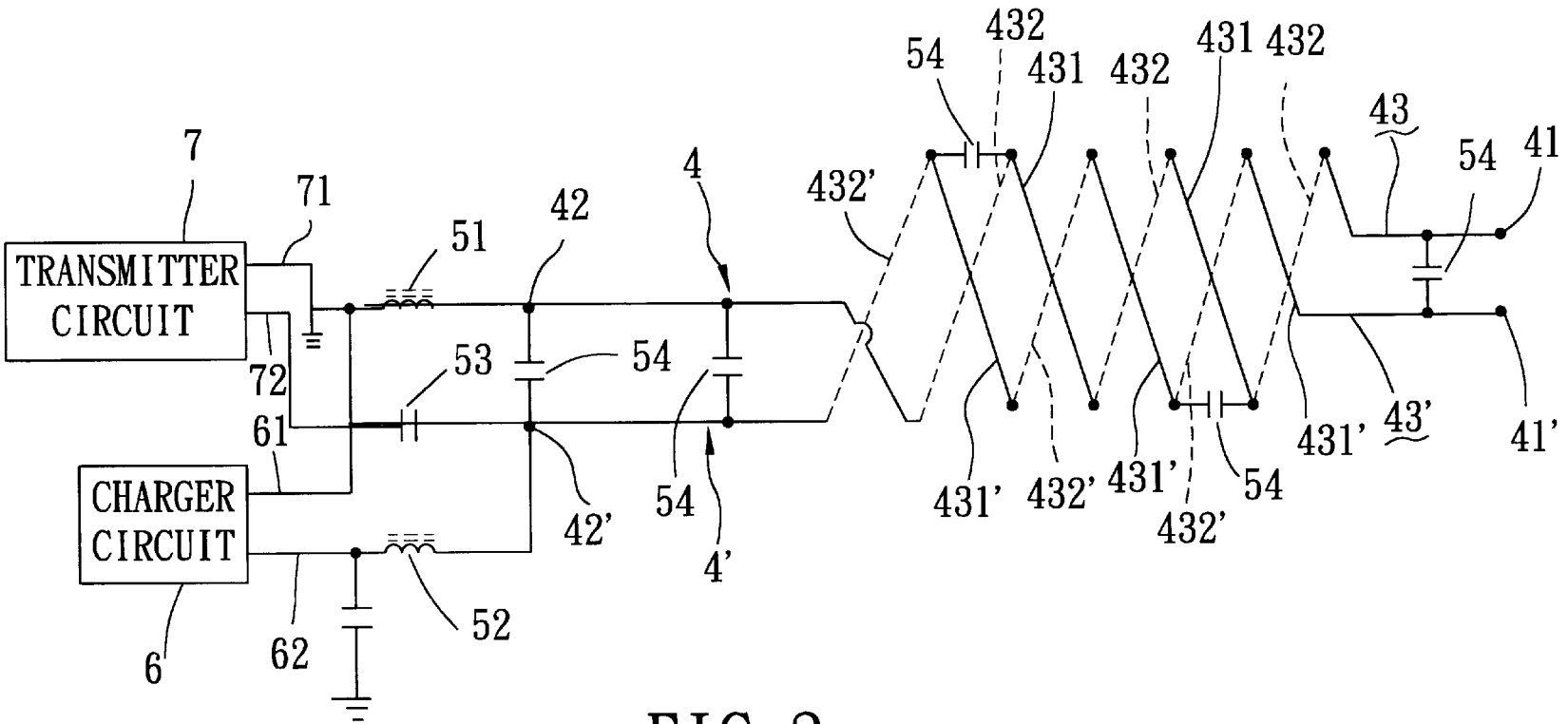
FIG. 2 is a schematic circuit diagram of the preferred embodiment.
Figure 3:
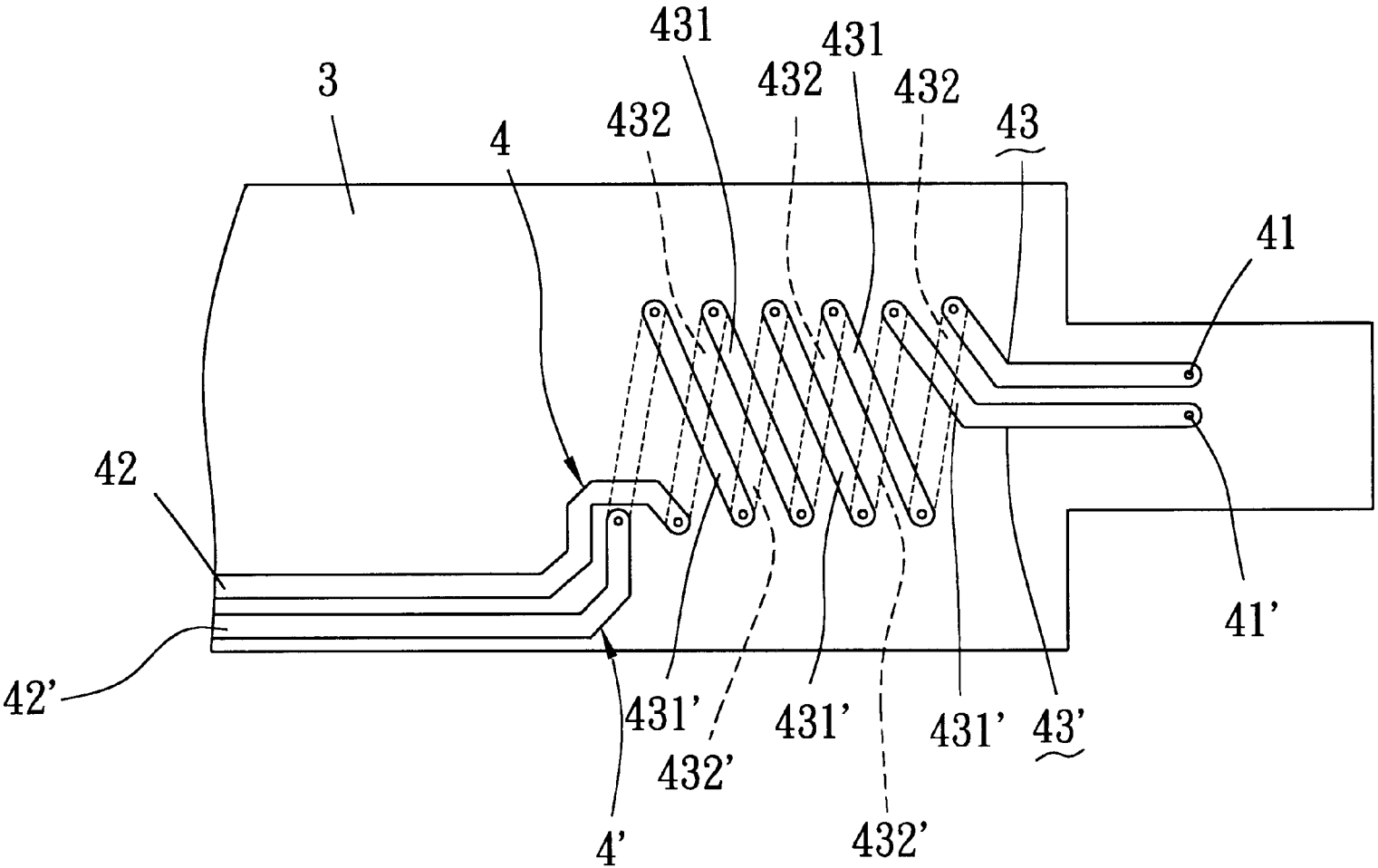
FIG. 3 is a fragmentary schematic view to illustrate how a common conductor pair is mounted on a circuit board in accordance with the preferred embodiment.

Referring to FIGS. 1 to 3, the preferred embodiment of a wireless microphone according to the present invention is shown to comprise a housing 2, a circuit board 3, a common conductor pair, a charger circuit 6, a transmitter circuit 7, first and second impedance coils 51, 52, and first and second isolation capacitors 53, 54.

The housing 2 is tubular and is configured for gripping by the user. The circuit board 3 is mounted in the housing 2, and has opposing first and second surfaces. The common conductor pair is mounted on the circuit board 3, and includes first and second conductors 4, 4', each of which has a charging end 41, 41', a connecting end 42, 42', and a wire portion 43, 43' between the charging and connecting ends 41, 41', 42, 42'. A known connector 31 is mounted on the circuit board 3 and is accessible externally of the housing 2. The connector 31 is connected electrically to the charging ends 41, 41' of the first and second conductors 4, 4', and permits connection of the first and second conductors 4, 4' to an external direct current power source (not shown) in a conventional manner.

In the preferred embodiment, the wire portion 43, 43' of each of the first and second conductors 4, 4' is strung on the circuit board 3 so as to form a plurality of parallel first wire segments 431, 431' on the first surface of the circuit board 3, and a plurality of parallel second wire segments 432, 432' on the second surface of the circuit board 3. Adjacent ones of the first wire segments 431, 431' of the wire portion 43, 43' of each of the first and second conductors 4, 4' are interconnected by a respective one of the second wire segments 432, 432'. The first wire segments 431, 431' of the wire portions 43, 43' of the first and second conductors 4, 4' are alternately disposed on the first surface of the circuit board 3. The second wire segments 432, 432' of the wire portions 43, 43' of the first and second conductors 4, 4' are also alternately disposed on the second surface of the circuit board 3. As such, the first wire segments 431 of the first conductor 4 cross the second wire segments 432' of the second conductor 4', whereas the first wire segments 431' of the second conductor 4' cross the second wire segments 432 of the first conductor 4.

The charger circuit 6 is used to charge an internal battery unit (not shown) in a conventional manner, and has a grounded first power terminal 61 and a second power terminal 62. The transmitter circuit 7 is used to output a microphone pick-up signal in a conventional manner, and has a grounded first signal terminal 71 and a second signal terminal 72. Since the feature of the present invention does not reside in the specific configurations of the charger circuit 6 and the transmitter circuit 7, which are known in the art, a detailed description of the same will be omitted herein for the sake of brevity.

The first impedance coil 51 has a grounded first coil terminal and a second coil terminal connected to the connecting end 42 of the first conductor 4. The second impedance coil 52 has a first coil terminal connected to the second power terminal 62, and a second coil terminal connected to the connecting end 42' of the second conductor 4'. As known in the art, the first and second impedance coils 51, 52 permit passage of direct current signals and prevent passage of alternating current signals therethrough.

The first isolation capacitor 53 has a first capacitor terminal connected to the second signal terminal 72, and a second capacitor terminal connected to the connecting end 42' of the second conductor 4'. Unlike the first and second impedance coils 51, 52, the first isolation capacitor 53 permits passage of alternating current signals and prevents passage of direct current signals therethrough.

In the preferred embodiment, a plurality of the second isolation capacitors 54 are connected across the first and second conductors 4, 4'. While it is possible to use only one isolation capacitor 54 in the wireless microphone of this invention, it is desirable that the number of the isolation capacitors 54 between the first and second conductors 4, 4' be increased in proportion to the lengths of the latter.

The wireless microphone of this invention is operable in at least a charging mode and a transmitting mode. When the wireless microphone is operated in the charging mode, a direct current power signal is supplied by the direct current power source (not shown) to the charging ends 41, 41' of the first and second conductors 4, 4'. The power signal will be prevented from reaching the transmitter circuit 7 by virtue of the characteristics of the first isolation capacitor 53, and will be directed to the charger circuit 6 by the second impedance coil 52, thereby enabling the charger circuit 6 to charge the internal battery unit (not shown) in a conventional manner. When the wireless microphone is operated in the transmitting mode, the transmitter circuit 7 outputs a microphone pick-up signal in a conventional manner. The microphone pick-up signal, which is an alternating current signal, will be prevented from reaching the charger circuit 6 by the first and second impedance coils 51, 52, and will be directed to the first and second conductors 4, 4' through the first and second isolation capacitors 53, 54. The wire portions 43, 43' of the first and second conductors 4, 4' are configured to act as radiating elements for wireless transmission of the microphone pick-up signal.

By virtue of the first and second impedance coils 51, 52 and the first and second isolation capacitors 53, 54 that connect the charger circuit 6 and the transmitter circuit 7 to the common conductor pair, and by virtue of the configurations of the wire portions 43, 43' of the first and second conductors 4, 4' of the common conductor pair on the circuit board 3, the required size of the circuit board 3 in the wireless microphone of this invention is smaller as compared to that in the prior art. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wireless microphone comprising:

a housing;

a circuit board mounted in said housing;

a common conductor pair mounted on said circuit board, said common conductor pair including first and second conductors, each of which has a charging end and a connecting end;

a charger circuit having a grounded first power terminal and a second power terminal;

a transmitter circuit having a grounded first signal terminal and a second signal terminal;

a first impedance coil having a grounded first coil terminal and a second coil terminal connected to said connecting end of said first conductor;

a second impedance coil having a first coil terminal connected to said second power terminal, and a second coil terminal connected to said connecting end of said second conductor;

a first isolation capacitor having a first capacitor terminal connected to said second signal terminal, and a second capacitor terminal connected to said connecting end of said second conductor; and at least a second isolation capacitor connected across said first and second conductors;

wherein, when a direct current power signal is supplied to said charging ends of said first and second conductors, the power signal will be prevented from reaching said transmitter circuit by said first isolation capacitor and will be directed to said charger circuit by said second impedance coil; and wherein, when said transmitter circuit outputs a microphone pick-up signal for transmission, the microphone pick-up signal will be prevented from reaching said charger circuit by said first and second impedance coils and will be directed to said first and second conductors through said first and second isolation capacitors for wireless transmission by said first and second conductors.

2. The wireless microphone as claimed in claim 1, further comprising a connector mounted on said circuit board and accessible externally of said housing, said connector being connected electrically to said charging ends of said first and second conductors, and being adapted to be connected to an external direct current power source so as to be adapted to permit supply of the direct current power signal to said charging ends of said first and second conductors.

3. A wireless microphone comprising:

a housing;

a circuit board mounted in said housing, said circuit board having opposing first and second surfaces;

a common conductor pair mounted on said circuit board, said common conductor pair including first and second conductors, each of which has a charging end, a connecting end, and a wire portion between said charging and connecting ends, said wire portion of each of said first and second conductors being strung on said circuit board so as to form a plurality of parallel first wire segments on said first surface of said circuit board, and a plurality of parallel second wire segments on said second surface of said circuit board, adjacent ones of said first wire segments of said wire portion of each of said first and second conductors being interconnected by a respective one of said second wire segments, said first wire segments of said wire portions of said first and second conductors being alternately-disposed on said first surface of said circuit board, said second wire segments of said wire portions of said first and second conductors being alternately disposed on said second surface of said circuit board;

a charger circuit having a grounded first power terminal and a second power terminal;

a transmitter circuit having a grounded first signal terminal and a second signal terminal;

a first impedance coil having a grounded first coil terminal and a second coil terminal connected to said connecting end of said first conductor;

a second impedance coil having a first coil terminal connected to said second power terminal, and a second coil terminal connected to said connecting end of said second conductor;

a first isolation capacitor having a first capacitor terminal connected to said second signal terminal, and a second capacitor terminal connected to said connecting end of said second conductor; and at least a second isolation capacitor connected across said first and second conductors;

wherein, when a direct current power signal is supplied to said charging ends of said first and second conductors, the power signal will be prevented from reaching said transmitter circuit by said first isolation capacitor and will be directed to said charger circuit by said second impedance coil;

wherein, when said transmitter circuit outputs a microphone pick-up signal for transmission, the microphone pick-up signal will be prevented from reaching said charger circuit by said first and second impedance coils and will be directed to said first and second conductors through said first and second isolation capacitors for wireless transmission by said wire portions of said first and second conductors.

4. The wireless microphone as claimed in claim 3, further comprising a connector mounted on said circuit board and accessible externally of said housing, said connector being connected electrically to said charging ends of said first and second conductors, and being adapted to be connected to an external direct current power source so as to be adapted to permit supply of the direct current power signal to said charging ends of said first and second conductors.

* * * * *